United States Patent [19]

Ishizuka et al.

[11] Patent Number: 4,563,580

[45] Date of Patent: Jan. 7, 1986

[54] RADIATION IMAGE STORAGE PANEL

[75] Inventors: Akio Ishizuka, Fujinomiya; Hisashi Yamazaki; Kikuo Yamazaki, both of Kaisei, all of Japan

[73] Assignee: Fuji Photo Film Company, Ltd., Kanagawa, Japan

[21] Appl. No.: 620,174

[22] Filed: Jun. 13, 1984

[30] Foreign Application Priority Data

Jun. 14, 1983 [JP] Japan ..... 58-106927

[51] Int. Cl.[4] ..... G03C 5/16

[52] U.S. Cl. ..... 250/327.2; 250/484.1; 428/690

[58] Field of Search ..... 250/327.2, 484.1; 252/301.26, 301.36; 428/690; 430/139

[56] References Cited

U.S. PATENT DOCUMENTS

| | | | |
|---|---|---|---|
| 4,239,968 | 12/1980 | Kotera et al. | 250/327.2 |
| 4,380,702 | 4/1983 | Takahashi et al. | 250/327.2 |
| 4,508,636 | 4/1985 | Ochiai | 252/301.36 |

*Primary Examiner*—Janice A. Howell

*Attorney, Agent, or Firm*—Murray, Whisenhunt & Ferguson

[57] ABSTRACT

A radiation image storage panel comprising a support, a subbing layer and a phosphor layer which comprises a binder and a stimulable phosphor dispersed therein, superposed in this order, characterized in that said subbing layer comprises a synthetic resin crosslinked with a crosslinking agent.

10 Claims, No Drawings

RADIATION IMAGE STORAGE PANEL

BACKGROUND OF THE INVENTION

1. Field of the Invention

This invention relates to a radiation image storage panel and more particularly, to a radiation image storage panel comprising a support, a subbing layer and a phoshor layer, superposed in this order.

2. Description of Prior Arts

For obtaining a radiation image, there has been conventionally employed a radiography utilizing a combination of a radiographic film having an emulsion layer containing a photosensitive silver salt material and a radiographic intensifying screen.

As a method replacing the above-described radiography, a radiation image recording and reproducing method utilizing a stimulable phosphor as described, for instance, in U.S. Pat. No. 4,239,968, has been recently paid much attention. In the radiation image recording and reproducing method, a radiation image storage panel comprising a stimulable phosphor (i.e., stimulable phosphor sheet) is used, and the method involves steps of causing the stimulable phosphor of the panel to absorb radiation energy having passed through an object or having radiated from an object; exciting the stimulable phosphor with an electromagnetic wave such as visible light and infrared rays (hereinafter referred to as "stimulating rays") to sequentially release the radiation energy stored in the stimulable phosphor as light emission (stimulated emission); photoelectrically detecting the emitted light to obtain electric signals; and reproducing the radiation image of the object as a visible image from the electric signals.

In the above-described radiation image recording and reproducing method, a radiation image can be obtained with a sufficient amount of information by applying a radiation to the object at considerably smaller dose, as compared with the case of utilizing the conventional radiography. Accordingly, this radiation image recording and reproducing method is of great value especially when the method is used for medical diagnosis.

The radiation image storage panel employed in the above-described radiation image recording and reproducing method has a basic structure comprising a support and a phosphor layer provided on one surface of the support. Further, a transparent film is generally provided on the free surface (surface not facing the support) of the phosphor layer to keep the phosphor layer from chemical deterioration or physical shock.

The phosphor layer comprises a binder and stimulable phosphor particles dispersed therein. The stimulable phosphor emits light (stimulated emission) when excited with stimulating rays after having been exposed to a radiation such as X-rays. Accordingly, the radiation having passed through an object or having radiated from an object is absorbed by the phosphor layer of the radiation image storage panel in proportion to the applied radiation dose, and the radiation image of the object is produced in the radiation image storage panel in the form of a radiation energy-stored image (latent image). The radiation energy-stored image can be released as stimulated emission (light emission) by applying stimulating rays to the panel, for instance, by scanning the panel with stimulating rays. The stimulated emission is then photoelectrically detected to give electric signals, so as to reproduce a visible image from the electric signals. It is desired for the radiation image storage panel employed in the radiation image recording and reproducing method to have a high mechanical strength and high resistance to flexing. That is because the handling of the panel is different from that of the radiographic intensifying screen employed in the conventional radiography, and the panel frequently encounters mechanical shock and receives mechanical force particularly in the course that the panel is irradiated with stimulating rays to read out the radiation energy stored therein.

More in detail, the radiation image storage panel is required to have a high mechanical strength so as not to allow easy separation of the phosphor layer from the support, when the mechanical shock and mechanical force caused by falling or bending of the panel are applied to the panel in use. Since the radiation image storage panel hardly deteriorates upon exposure to a radiation or to an electromagnetic wave ranging from visible light to infrared rays, the panel can be repeatedly employed for a long period of time. Accordingly, the panel subjected to the repeated use is required not to encounter such troubles as the separation between the phosphor layer and support caused by the mechanical shock applied in handling of the panel in a procedure of exposure the panel to a radiation, in a procedure of reproducing a visible image brought about by excitation the panel with an electromagnetic wave after the exposure to the radiation, and in a procedure of erasure of the radiation image remaining in the panel.

The radiation image storage panel has a tendency that the bonding strength between the phosphor layer and the support is decreased as the mixing ratio of the binder to the stimulable phosphor (binder/stimulable phosphor) in the phosphor layer is decresed in order to enhance the sensitivity. The bonding strength therebetween also tends to decrease in the case that the phosphor layer is formed on the support under such conditions that the phosphor particles deposit on the lower side (i.e., the support side), which taking place depending upon the nature of phosphor particles and binder, the coating conditions of the binder solution (coating dispersion), etc.

For enhancing the bonding strength between the phosphor layer and the support which is apt to decrease as described above, it has been known that a subbing layer is provided therebetween. Such subbing layer is formed using a known adhesive agent comprising a synthetic resin. However, when the phosphor layer is formed on the surface of the conventional subbing layer of the support, utilizing the conventional coating procedure, the bonding strength therebetween cannot reach an appropriate level because the material of subbing layer is partly dissolved in the solvent of the coating dispersion for the phosphor layer.

Further, in the conventional procedure of forming a layer of coating dispersion for the phosphor layer, the subbing layer is once swollen by the solvent contained in the coating dispersion and then shrinked, so that cracks are apt to occur on the resulting phosphor layer. Especially in the case that the subbing layer is flexible and the binder of the phosphor layer is relatively rigid, cracks are probably produced on the phosphor layer. Since the occurrence of cracks on the phosphor layer results in deteriorating the quality of an image provided by the panel, it is required to prevent the occurrence of cracks on the phosphor layer.

In the radiation image storage panel having a protective film provided on the phosphor layer, the protective film is usually formed by laminating the surface of the phosphor layer with the film using an adhesive agent under heating and pressure. In the case that the subbing layer is not sufficiently rigid, a portion of the subbing layer is depressed or dislocated in the laminating procedure to bring about uneveness of the thickness thereof or dislocation of the phosphor layer from the support. As a result of such plastic deformation, wrinkles (lamination wrinkles) are likely produced on the surface of the protective film of the resulting panel, or the panel is entirely deformed to have a curved face (namely, curling).

SUMMARY OF THE INVENTION

It is an object of the present invention to provide a radiation image storage panel which is improved in the mechanical strength, particularly in the bonding strength between the phosphor layer and the support.

It is another object of the present invention to provide a radiation image storage panel which is substantially free from the occurrence of cracks on the phosphor layer.

It is a further object of the present invention to provide a radiation image storage panel which is reduced in the production of lamination wrinkles and the production of curling of the panel in the procedure of laminating a protective film.

As the results of the studies, the present inventor has found that the above-mentioned objects can be accomplished by employing a synthetic resin crosslinked with a crosslinking agent as the material of a subbing layer in the radiation image storage panel to make the subbing layer rigid through curing.

The present invention provides a radiation image storage panel comprising a support, a subbing layer and a phosphor layer which comprises a binder and a stimulable phosphor dispersed therein, superposed in this order, characterized in that said subbing layer comprises a synthetic resin crosslinked with a crosslinking agent.

DETAILED DESCRIPTION OF THE INVENTION

In the radiation image storage panel of the present invention, prominent enhancement of mechanical strength of the panel as well as effective prevention of occurrence of cracks on the phosphor are accomplished by employing as the subbing layer a synthetic resin layer to which a crosslinking agent is added to make the subbing layer cured.

The employment of a synthetic resin crosslinked with a crosslinking agent as the material of the subbing layer is effective to make the subbing layer insoluble or sparingly soluble in the solvent contained in the coating dispersion for the formation of the phosphor layer, so that the effect of provision of a subbing layer is prominently increased to enhance the bonding strength between the phosphor layer and the support. The radiation image storage panel of the present invention is improved in the mechanical strength against the mechanical shocks such as given in falling or bending the panel as compared with the conventional panel.

The degree of swelling and shrinking of the subbing layer occurring in the procedure for forming a layer of coating dispersion for the phosphor layer is reduced to a low level, because the resin employed for the subbing layer is cured with a crosslinking agent. As a result, the occurrence of cracks on the phosphor layer, which is apt to occur in the conventional radiation image storage panel having a phosphor layer provided on a subbing layer by the usual coating procedure is effectively reduced. Accordingly, it is possible for the radiation image storage panel of the present invention to provide an image of high quality.

Further, in the case of providing a protective film comprising a plastic film onto the phosphor layer by lamination, the occurrence of wrinkles on the surface of the protective film and the curling of the panel which are generally observed in the conventional panel owing to the plastic deformation of the subbing layer are effectively prevented or remarkably reduced. Accordingly, the procedure of laminating the protective film is rendered easier than the conventional procedure and further the resulting radiation image storage panel can provide an image of high quality.

The radiation image storage panel of the present invention having the above-described advantages can be prepared, for instance, in the following manner.

The subbing layer, that is a characteristic requisite of the present invention, comprises a synthetic resin crosslinked by addition of a crosslinking agent.

Examples of the crosslinkable synthetic resin include polyacrylic resins, polyester resins, polyerethane resins, polyvinyl acetate resins and ethylene-vinyl acetate copolymers. Examples of the crosslinking agent employable to crosslinking said synthetic resins include aliphatic isocyanates, aromatic isocyanates, melamine, amino resin and the derivatives thereof.

A subbing layer can be formed on the support by the following procedure. A synthetic resin and a crosslinking agent are added to an appropriate solvent and they are well mixed to prepare a coating solution. The content of the crosslinking agent varies depending on the characteristics of the aimed radiation image storage panel, the materials employed for the phosphor layer and the support, and the kind of synthetic resin of the subbing layer. From the viewpoint of the enhancement of bonding strength between the phosphor layer and the support, the content of the crosslinking agent is not more than 20% by weight of the systhetic resin.

The solvent employable in the preparation of the coating solution can be selected from solvents employable in the preparation of a phosphor layer mentioned below. The coating solution is uniformly applied onto the surface of the support to form a layer of the coating solution. The coating procedure can be carried out by a conventional method such as a method using a doctor blade, a roll coater or a knife coater. Subsequently the layer of coating solution is heated slowly to dryness so as to complete the formation of a subbing layer.

Thus, a rigid subbing layer of the synthetic resin cured with the crosslinking agent is formed on the support. The thickness of the subbing layer preferably ranges from 3 to 50 $\mu$m.

The support material employed in the present invention can be selected from those employed in the conventional radiographic intensifying screens or those employed in the known radiation image storage panels. Examples of the support material include plastic films such as films of cellulose acetate, polyester, polyethylene terephthalate, polyamide, polyimide, triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. From the viewpoint of characteristics of a radiation image storage panel as an information recording material, a plastic film is preferably employed as the support material of the invention. The plastic film may contain a light-absorbing material such as carbon black, or may contain a light-reflecting material such as titanium dioxide. The former is appropriate for preparing a high-sharpness type radiation image storage panel, while the latter is appropriate for preparing a high-sensitivity type radiation image storage panel.

In the preparation of a known radiation image storage panel, a light-reflecting layer or a light-absorbing layer is occasionally provided on the support so as to improve the sensitivity of the panel or the quality of an image provided thereby. The light-reflecting layer or light-absorbing layer may be provided by forming a polymer material layer containing a light-reflecting material such as titanium dioxide or a light-absorbing material such as carbon black. In the invention, one or more of these additional layers may be provided on the support.

As described in Japanese Patent Provisional Publication No. 58(1983)-200200 (corresponding to U.S. patent application No. 496,278 and European Patent Publication No. 92241), the phosphor layer-side surface of the support having the subbing layer (i.e., the surface of the subbing layer) may be provided with protruded and depressed portions for enhancement of the sharpeness of the image.

On the subbing layer prepared as described above, a phosphor layer is formed. The phosphor layer comprises a binder and stimulable phosphor particles dispersed therein.

The stimulable phosphor, as described hereinbefore, gives stimulated emission when excited with stimulating rays after exposure to a radiation. From the viewpoint of practical use, the stimulable phosphor is desired to give stimulated emission in the wavelength region of 300–500 nm when excited with stimulating rays in the wavelength region of 400–850 nm.

Examples of the stimulable phosphor employable in the radiation image storage panel of the present invention include:

SrS:Ce,Sm, SrS:Eu,Sm, $ThO_2$:Er, and $La_2O_2S$:Eu,Sm, as described in U.S. Pat. No. 3,859,527;

ZnS:Cu,Pb, BaO.x$Al_2O_3$:Eu, in which x is a number satisfying the condition of $0.8 \leqq \times \leqq 10$, and $M^{2+}$O. x$SiO_2$:A, in which $M^{2+}$is at least one divalent metal selected from the group consisting of Mg, Ca, Sr, Zn, Cd and Ba, A is at least one element selected from the group consisting of Ce, Tb, Eu, Tm, Pb, Tl, Bi and Mn, and x is a number satisfying the condition of $0.5 \leqq \times \leqq 2.5$, as described in U.S. Pat. No. 4,326,078;

$(Ba_{1-x-y},Mg_x,Ca_y)FX:aEu^{2+}$, in which X is at least one element selected from the group consisting of Cl and Br, x and y are numbers satisfying the conditions of $0 < x+y \leqq 0.6$, and $xy \neq 0$, and a is a number satisfying the condition of $10^{-6} \leqq a \leqq 5 \times 10^{-2}$, as described in Japanese Patent Provisional Publication No. 55(1980)-12143;

LnOX:xA, in which Ln is at least one element selected from the group consisting of La, Y, Gd and Lu, X is at least one element selected from the group consisting of Cl and Br, A is at least one element selected from the group consisting of Ce and Tb, and x is a number satisfying the condition of $0 < x < 0.1$, as described in the above-mentioned U.S. Pat. No. 4,236,078;

$(Ba_{1-x},M^{II}_x)FX:yA$, in which $M^{II}$ is at least one divalent metal selected from the group consisting of Mg, Ca, Sr, Zn and Cd, X is at least one element selected from the group consisting of Cl, Br, and I, A is at least one element selected from the group consisting of Eu, Tb, Ce, Tm, Dy, Pr, Ho, Nd, Yb and Er, and x and y are numbers satisfying the conditions of $0 \leqq x \leqq 0.6$ and $0 \leqq y \leqq 0.2$, respectively, as described in Japanese Patent Provisional Publication No. 55(1980)-12145;

$M^{II}FX.xA:yLn$, in which $M^{II}$ is at least one element selected from the group consisting of Ba, Ca, Sr, Mg, Zn and Cd; A is at least one compound selected from the group consisting of BeO, MgO, CaO, SrO, BaO, ZnO, $Al_2O_3$, $Y_2O_3$, $La_2O_3$, $In_2O_3$, $SiO_2$, $TiO_2$, $ZrO_2$, $GeO_2$, $SnO_2$, $Nb_2O_5$, $Ta_2O_5$ and $ThO_2$; Ln is at least one element selected from the group consisting of Eu, Tb, Ce, Tm, Dy, Pr, Ho, Nd, Yb, Er, Sm and Gd; X is at least one element selected from the group consisting of Cl, Br, and I; and x and y are numbers satisfying the conditions of $5 \times 10^{-5} \leqq x \leqq 0.5$ and $0 < y \leqq 0.2$, respectively, as described in Japanese Patent Provisional Publication No. 55(1980)-160078;

$(Ba_{1-x},M^{II}_x)F_2.aBaX_2:yEu,zA$, in which $M^{II}$ is at least one element selected from the group consisting of Be, Mg, Ca, Sr, Zn and Cd; X is at least one element selected from the group consisting of Cl, Br and I; A is at least one element selected from the group consisting of Zr and Sc; and a, x, y and z are numbers satisfying the conditions of $0.5 \leqq a \leqq 1.25$, $0 \leqq x \leqq 1$, $10^{-6} \leqq y \leqq 2 \times 10^{-1}$, and $0 < z \leqq 10^{-2}$, respectively, as described in Japanese Patent Provisional Publication No. 56(1981)-116777;

$(Ba_{1-x},M^{II}_x)F_2.aBaX_2:yEu,zB$, in which $M^{II}$ is at least one element selected from the group consisting of Be, Mg, Ca, Sr, Zn and Cd; X is at least one element selected from the group consisting of Cl, Br and I; and a, x, y and z are numbers satisfying the conditions of $0.5 \leqq a \leqq 1.25$, $0 \leqq x \leqq 1$, $10^{-6} \leqq y \leqq 2 \times 10^{-1}$, and $0 < x \leqq 2 \times 10^{-1}$, respectively, as described in Japanese Patent Provisional Publication No. 57(1982)-23673;

$(Ba_{1-x},M^{II}_x)F_2.aBaX_2:yEu,zA$, in which $M^{II}$ is at least one element selected from the group consisting of Be, Mg, Ca, Sr, Zn and Cd; X is at least one element selected from the group consisting of Cl, Br and I; A is at least one element selected from the group consisting of As and Si; and a, x, y and z are numbers satisfying the conditions of $0.5 \leqq a \leqq 1.25$, $0 \leqq x \leqq 1$, $10^{-6} \leqq y \leqq 2x \times 10^{-1}$, and $0 < z \leqq \times 10^{-1}$, respectively, as described in Japanese Patent Provisional Publication No. 57(1982)-23675;

$M^{III}OX:xCe$, in which $M^{III}$ is at least one trivalent metal selected from the group consisting of Pr, Nd, Pm, Sm, Eu, Tb, Dy, Ho, Er, Tm, Yb, and Bi; X is at least one element selected from the group consisting of Cl and Br; and x is a number satisfying the condition of $0 < x < 0.1$, as described in Japanese Patent Provisional Publication No. 58(1983)-69281;

$Ba_{1-x}M_{x/2}L_{x/2}FX:yEu^{2+}$, in which M is at least one alkali metal selected from the group consisting of Li, Na, K, Rb and Cs; L is at least one trivalent metal selected from the group consisting of Sc, Y, La, Ce, Pr, Nd, Pm, Sm, Gd, Tb, Dy, Ho, Er, Tm, Yd, Lu, Al, Ga, In and Tl; X is at least one halogen selected from the group consisting of Cl, Br, and I;

and x and y are numbers satisfying the conditions of $10^{-2} \leqq x \leqq 0.5$ and $0 < y \leqq 0.1$, respectively, as described in Japanese Patent Provisional Publication No. 58(1983)-206678;

$BaFX.xA:yEu^{2+}$, in which X is at least one halogen selected from the group consisting of Cl, Br and I; A is at least one fired product of a tetrafluoroboric acid compound; and x and y are numbers satisfying the conditions of $10^{-6} \leqq x \leqq 0.1$ and $0 < y \leqq 0.1$, respectively, as described in Japanese Patent Provisional Publication No. 59(1984)-27980;

$BaFX.xA:yEu^{2+}$, in which X is at least one halogen selected from the group consisting of Cl, Br and I; A is at least one fired product of a hexafluoro compound selected from the group consisting of monovalent and divalent metal salts of hexafluoro silicic acid, hexafluoro titanic acid and hexafluoro zirconic acid; and x and y are numbers satisfying the conditions of $10^{-6} \leqq x \leqq 0.1$ and $0 < y \leqq 0.1$, respectively, as described in Japanese Patent Provisional Publication No. 59(1984)-47289;

$BaFX.xNaX':aEu^{2+}$, in which each of X and X' is at least one halogen selected from the group consisting of Cl, Br and I; and x and a are numbers satisfying the conditions of $0 < x \leqq 2$ and $0 < a \leqq 0.2$, respectively, as described in Japanese Patent Provisional Publication No. 59(1984)-56479;

$M^{II}FX.xNaX':yEu^{2+}.zA$, in which $M^{III}$ is at least one alkaline earth metal selected from the group consisting of Ba, Sr and Ca; each of X and X' is at least one halogen selected from the group consisting of Cl, Br and I; A is at least one transition metal selected from the group consisting of V, Cr, Mn, Fe, Co and Ni; and x, y and z are numbers satisfying the conditions of $0 < x \leqq 2$, $0 < y \leqq 0.2$ and $0 < z \leqq 10^{-2}$, respectively, as described in Japanese Patent Provisional Publication No. 59(1984)-56480; and $M^{II}FX.aM^{I}X'.bM'^{II}X''_2.cM^{III}X'''_3.xA:yEu^{2+}$, in which $M^{II}$ is at least one alkaline earth metal selected from the group consisting of Ba, Sr and Ca; $M^{I}$ is at least one alkali metal selected from the group consisting of Li, Na, K, Rb and Cs; $M'^{II}$ is at least one divalent metal selected from the group consisting of Be and Mg; $M^{III}$ is at least one trivalent metal selected from the group consisting of Al, Ga, In and Tl; A is at least one metal oxide; X is at least one halogen selected from the group consisting of Cl, Br and I; each of X', X'' and X''' is at least one halogen selected from the group consisting of F, Cl, Br and I; a, b and c are numbers satisfying the conditions of $0 \leqq a \leqq 2$, $0 \leqq b \leqq 10^{-2}$, $0 \leqq c \leqq 10^{-2}$ and $a+b+c \leqq 10^{-6}$; and x and y are numbers satisfying the conditions of $0 < x \leqq 0.5$ and $0 < y \leqq 0.2$, respectively, as described in Japanese Patent Application No. 57(1982)-184455.

The above-described stimulable phosphors are given by no means to restrict the stimulable phosphor employable in the present invention. Any other phosphor can be also employed, provided that the phosphor gives stimulated emission when excited with stimulating rays after exposure to a radiation.

Examples of the binder to be contained in the phosphor layer include: natural polymers such as proteins (e.g. gelatin), polysaccharides (e.g. dextran) and gum arabic; and synthetic polymers such as polyvinyl butyral, polyvinyl acetate, nitrocellulose, ethylcellulose, vinylidene chloride-vinyl chloride copolymer, polyalkyl (meth)acrylate, vinyl chloride-vinyl acetate copolymer, polyurethane, cellulose acetate butyrate, polyvinyl alcohol, and linear polyester. Particularly preferred are nitrocellulose, linear polyester, polyalkyl (meth)acrylate, a mixture of nitrocellulose and linear polyester, and a mixture of nitrocellulose and polyalkyl (meth)acrylate. The binder may be crosslinked with a crosslinking agent.

The phosphor layer can be formed on the subbing layer, for instance, by the following procedure.

In the first place, stimulable phosphor particles and a binder are added to an appropriate solvent, and then they are mixed to prepare a coating dispersion of the phosphor particles in the binder solution.

Examples of the solvent employable in the preparation of the coating dispersion include lower alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether and ethylene glycol monoethyl ether; and mixtures of the above-mentioned compounds.

The ratio between the binder and the stimulable phosphor in the coating dispersion may be determined according to the characteristics of the aimed radiation image storage panel and the nature of the phosphor employed. Generally, the ratio therebetween is within the range of from 1:1 to 1:100 (binder:phosphor, by weight), preferably from 1:8 to 1:50.

The coating dispersion may contain a dispersing agent to improve the dispersibility of the phosphor particles therein, and may contain a variety of additives such as a plasticizer for increasing the bonding between the binder and the phosphor particles in the phosphor layer. Examples of the dispersing agent include phthalic acid, stearic acid, caproic acid and a hydrophobic surface active agent. Examples of the plasticizer include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion containing the phosphor particles and the binder prepared as described above is applied evenly to the surface of the subbing layer to form a layer of the coating dispersion. The coating procedure can be carried out by a conventional method such as a method using a doctor blade, a roll coater or a knife coater.

After applying the coating dispersion to the subbing layer, the coating dispersion is then heated slowly to dryness so as to complete the formation of a phosphor layer. The thickness of the phosphor layer varies depending upon the characteristics of the aimed radiation image storage panel, the nature of the phosphor, the ratio between the binder and the phosphor, etc. Generally, the thickness of the phosphor layer is within the range of from 20 μm to 1 mm, and preferably from 50 to 500 μm.

In the case that the binder constituting the phosphor layer is reactive to the crosslinking agent contained in the subbing layer, the binder reacts with unreacted group of the crosslinking agent on the interface between the phosphor layer and the subbing layer in the procedure of forming a phosphor layer, so as to enhance the bonding strength between the subbing layer and the phosphor layer. Particularly in the case that the binder composition also contains such a crosslinking agent as being reactive to the synthetic resin of the subbing layer in addition to the binder as such being reactive to the crosslinking agent contained in the subbing layer, the bonding strength therebetween is more enhanced.

The radiation image storage panel generally has a transparent film on a free surface of a phosphor layer to protect the phosphor layer from physical and chemical deterioration. In the radiation image storage panel of the present invention, it is preferable to provide a transparent film for the same purpose.

The transparent film can be provided onto the phosphor layer by beforehand preparing it from a polymer such as polyethylene terephthalate, polyethylene, polyvinylidene chloride or polyamide, followed by laminating it onto the phosphor layer with an appropriate adhesive agent. In the present invention, the subbing layer which is made rigid by adding the crosslinking agent thereto is provided between the support and the phosphor layer, so that the wrinkles are hardly produced on the surface of the protective film and the resulting panel is hardly curled even after the protective film is provided on the phosphor layer by the lamination procedure.

Alternatively, the transparent film can be provided onto the phosphor layer by coating the surface of the phosphor layer with a solution of a transparent polymer such as a cellulose derivative (e.g. cellulose acetate or nitrocellulose), or a synthetic polymer (e.g. polymethyl methacrylate, polyvinyl butyral, polyvinyl formal, polycarbonate, polyvinyl acetate, or vinyl chloride-vinyl acetate copolymer), and drying the coated solution. The transparent protective film preferably has a thickness within a range of approx. 3 to 20 μm.

The radiation image storage panel of the present invention may be colored with such a colorant that the mean reflectance thereof in the wavelength region of stimulating rays for the stimulable phosphor is smaller than that in the wavelength region of stimulated emission to improve the sharpess of the image provided thereby as described in Japanses Patent Provisional Publication No. 57(1982)-96300.

The following examples will illustrate the present invention, but these examples are by no means to restrict the invention. In the following examples, the term of "part" means "part by weight", unless otherwise specified.

EXAMPLE 1

A polyacrylic resin (trade name: Criscoat P-1018GS, available from Dainippon Ink & Chemicals Inc., Japan) and aliphatic isocyanate (crosslinking agent; trade name:Sumidul N, available from Sumitomo Bayer Urethane Co., Ltd., Japan) were added to methyl ethyl ketone to prepare a coating solution.

Composition of the Coating Solution

Polyacrylic resin—100 parts
Aliphatic isocyanate—3 parts
Methyl ethyl ketone—1127 parts Then the coating solution was evenly applied onto a polyethylene terephthalate film containing carbon black (support, thickness: 250 μm) placed horizontally on a glass plate. The application of the coating dispersion was carried out using a doctor blade. After the coating was complete, the support having a layer of the coating solution was heated to dryness in an oven to prepare a subbing layer having the thickness of approx. 30 μm on the support.

To a mixture of a particulate divalent europium activated alkaline earth metal fluorobromide ($BaFBr:Eu^{2+}$) phosphor, nitrocellulose and a polyacrylic resin were added to methyl ethyl ketone, to prepare a dispersion containing the binder and phosphor particles in the ratio of 1:25 (binder: phosphor, by weight). Aliphatic isocyanate, tricresyl phosphate and methyl ethyl ketone were added to the dispersion and the mixture was sufficiently stirred by means of a propeller agitater to obtain a homogeneous coating dispersion having a viscosity of 25–35 PS (at 25° C.).

Composition of Coating Dispersion $BaFBr:Eu^{2+}$ *phosphor*—500 parts
Polyacrylic resin—16 parts
Nitrocellulose—2.5 parts
Aliphatic isocyanate—1.0 part
Tricresyl phosphate—0.5 part
Methyl ethyl ketone—95 parts Then the coating dispersion was evenly applied onto the surface of the subbing layer provided on the support. The application of the coating dispersion was carried out using a doctor blade. After the coating was complete, the support having a layer of the coating dispersion was heated to dryness under air stream at 90° C. and at a flow rate of 1.0 m/sec. for 10 min. Thus, a phosphor layer having the thickness of approx. 250 μm was formed on the support.

On the phosphor layer was placed a polyethylene terephthalate transparent film (thickness: 12 μm; provided with a polyester adhesive layer on one surface) to laminate the film and the phosphor layer with the adhesive layer. Thus, a radiation image storage panel consisting essentially of a support, a subbing layer, a phosphor layer and a transparent protective film was prepared.

COMPARISON EXAMPLE 1

A radiation image storage panel consisting essentially of a support, a subbing layer, a phosphor layer and a transparent protective film was prepared in the same manner as described in Example 1, except that aliphatic isocyanate was not added to the coating solution of Example 1, to prepare a coating solution for the subbing layer having the following composition.

Composition of the Coating Solution

Polyacrylic resin—100 parts
Methyl ethyl ketone—1130 parts

The radiation image storage panels prepared in Example 1 and Comparison Example 1 were evaluated on the bonding strength between the phosphor layer and the support and the occurrence of cracks according to the following tests.

(1) Bonding strength

The radiation image storage panel was cut to give a test strip (specimen) having a width of 10 mm, and the test strip was given a notch along the interface between the phosphor layer and the support (or the support provided with the subbing layer). In a tensile testing machine (Tensilon UTM-II-20 manufactured by Toyo Balodwin Co., Ltd., Japan), the support part and the part consisting of the phosphor layer and protective film of the so notched test strip were forced to separate from each other by pulling one part from another part in the rectangular direction (peel angle: 90°) at a rate of 10 mm/min. The bonding strength was determined just when a 10-mm long phosphor layer portion was peeled from the support. The strength (peel strength) is expressed in terms of the force F (g./cm).

(2) Occurrence of cracks

The radiation image storage panel was cut along the depth direction and the cross-section of the phosphor layer was observed with eyes to evaluate the occurrence of cracks. The results are expressed by the following three levels of A to C.

A: the cracks hardly occurred on the phosphor layer.
B: The cracks occurred on the phosphor layer.
C: The cracks noticeably occurred on the phosphor layer.

The results of the evaluation on the radiation image storage panels are set forth in Table 1.

TABLE 1

| | Bonding Strength (g./cm) | Occurence of Cracks |
|---|---|---|
| Example 1 | 650 | A |
| Com. Example 1 | 580 | C |

As is evident from the results set forth in Table 1, the radiation image storage panel according to the present invention (Example 1) had an increased bonding strength between the phosphor layer and the support, and was substantially free from the occurrence of cracks on the phosphor layer. In contrast, although the radiation image storage panel having the conventional subbing layer (Comparison Example 1) had satisfactory bonding strength, the cracks noticeably occurred in the phosphor layer.

Further, it is evident from the results of eye observation that the radiation image storage panel of the present invention (Example 1) had not lamination wrinkles on the surface of the protective film, and that the curling of panel was not produced and thus a satisfactorily plane panel was prepared.

EXAMPLE 2

A radiation image storage panel consisting essentially of a support, a subbing layer, a phosphor layer and a transparent protective film was prepared in the same manner as described in Example 1, except that a polyurethane resin (trade name: Crisvon NT-150, available from Dainippon Ink & Chemicals Inc.) and an aliphatic isocyanate (crosslinking agent; trade name: Sumidul N, available from Sumitomo Bayer Urethane Co., Ltd.) were added to methyl ethyl ketone to prepare a coating solution for the subbing layer having the following composition.

Compositon of Coating Solution

Polyurethane resin—100 parts
Aliphatic isocyanate—3 parts
Methyl ethyl ketone—1150 parts Comparison Example 2

A radiation image storage panel consisting essentially of a support, a subbing layer, a phosphor layer and a transparent protective film was prepared in the same manner as described in Example 2, except that aliphatic isocyanate was not added to the coating solution of Example 2 to prepare a coating solution for the subbing layer having the following composition.

Composition of Coating Solution

Polyurethane resin—100 parts
Methyl ethyl ketone—1153 parts

The radiation image storage panels prepared in Example 2 and Comparison Example 2 were evaluated on the above-described bonding strength and occurrence of cracks.

The results of the evaluation on the radiation image storage panels are set forth in Table 2.

TABLE 2

| | Bonding Strength (g./cm) | Occurence of Cracks |
|---|---|---|
| Example 2 | 430 | A |
| Com. Example 2 | 360 | C |

As is evident from the results set forth in Table 2, the radiation image storage panel according to the present invention (Example 2) was enhanced in the bonding strength between the phosphor layer and the support and was substantially free from occurrence of cracks on the phosphor layer, as compared with the radiation image storage panel having the conventional subbing layer (Comparison Example 2).

Further, it was evident from the results of eye observation that the radiation image storage panel of the present invention (Example 2) had not lamination wrinkles on the surface of the protective film, and that the curling of panel was not produced and thus a satisfactorily plane panel was prepared.

EXAMPLE 3

A radiation image storage panel consisting essentially of a support, a subbing layer, a phosphor layer and a transparent protective film was prepared in the same manner as described in Example 1, except that a polyester resin (trade name: Vylon 30P, available from Toyobo Co., Ltd., Japan) and methylated melamine (crosslinking agent; trade name: Sumimal M-40S, available from Sumitomo Chemical Co., Ltd., Japan) were added to ethylene dichloride to prepare a coating solution for the subbing layer having the following composition.

Composition of Coating Solution

Polyester resin—100 parts
Methylated melamine—25 parts
Ethylene dichloride—1375 parts Comparison Example 3

A radiation image storage panel consisting essentially of a support, a subbing layer, a phosphor layer and a transparent protective film was prepared in the same manner as described in Example 3, except that methylated melamine was not added to the coating solution of Example 3 to prepare a coating solution for the subbing layer having the following composition.

Composition of Coating Solution

Polyester resin—100 parts
Ethylene dichloride—1400 parts

The radiation image storage panels prepared in Example 3 and Comparison Example 3 were evaluated on the above-described bonding strength and occurrence of cracks.

The results of the evaluation on the radiation image storage panels are set forth in Table 3.

TABLE 3

| | Bonding Strength (g./cm) | Occurence of Cracks |
|---|---|---|
| Example 3 | 400 | A |
| Com. Example 3 | 300 | A |

As is evident from the results set forth in Table 3, the radiation image storage panel according to the present invention (Example 3) was enhanced in the bonding strength between the phosphor layer and the support, as compared with the radiation image storage panel having the conventional subbing layer (Comparison Example 3). The both panels were substantially free from the occurrence of cracks on the phosphor layer. The effective prevention of cracks occurring in the conventional panel is presumed to be brought about by making the resin of the subbing layer insoluble in the solvent of the phoshor layer so as not to swell the subbing layer.

Further, it was evident from the results of eye observation that the radiation image storage panel of the present invention (Example 3) had not lamination wrinkles on the surface of the protective film and that the curling of panel was not produced and thus a satisfactorily plane panel was prepared.

We claim:

1. A radiation image storage panel comprising a support, a subbing layer and a phosphor layer which comprises a binder and a stimulable phosphor dispersed therein, superposed in this order, characterized in that said subbing layer comprises a synthetic resin crosslinked with a crosslinking agent.

2. The radiation image storage panel as claimed in claim 1, in which a protective film of a plastic material is provided on said phosphor layer.

3. The radiation image storage panel as claimed in claim 1, in which said crosslinking agent is reactive to a hydroxyl group.

4. The radiation image storage panel as claimed in claim 3, in which said crosslinking agent is at least one compound selected from the group consisting of isocyanate, a derivative thereof, melamine and a derivative thereof, and amino resin and a derivative thereof.

5. The radiation image storage panel as claimed in any one of claims 1 through 4, in which said synthetic resin is at least one resin selected from the group consisting of polyacrylic resin, polyester resin, polyurethane resin, polyvinyl acetate resin and ethylene-vinyl acetate copolymer.

6. The radiation image storage panel as claimed in claim 1, in which said crosslinked systhetic resin contains the crosslinking agent of not more than 20% by weight of the resin.

7. The radiation image storage panel as claimed in claim 1, in which said subbing layer comprises a polyacrylic resin crosslinked with an aliphatic isocyanate.

8. The radiation image storage panel as claimed in claim 1, in which said subbing layer comprises a polyurethane resin crosslinked with an aliphatic isocyanate.

9. The radiation image storage panel as claimed in claim 1, in which said subbing layer comprises a polyester resin crosslinked with a methylated melamine.

10. The radiation image storage panel as claimed in claim 1, in which said binder of the phosphor layer contains a polyacrylic resin crosslinked with an aliphatic isocyanate.

* * * * *